US010561297B2

(12) United States Patent
Maslana

(10) Patent No.: US 10,561,297 B2
(45) Date of Patent: Feb. 18, 2020

(54) WIRE FRAME DRYING RACK

(71) Applicant: Prince Castle LLC, Carol Stream, IL (US)

(72) Inventor: Eugene S. Maslana, Arlington Heights, IL (US)

(73) Assignee: Prince Castle LLC, Carol Stream, IL (US)

( * ) Notice: Subject to any disclaimer, the term of this patent is extended or adjusted under 35 U.S.C. 154(b) by 0 days.

(21) Appl. No.: 16/181,984

(22) Filed: Nov. 6, 2018

(65) Prior Publication Data

US 2019/0133413 A1 May 9, 2019

Related U.S. Application Data

(60) Provisional application No. 62/582,578, filed on Nov. 7, 2017.

(51) Int. Cl.

| | |
|---|---|
| ***A47L 19/04*** | (2006.01) |
| ***A47B 96/02*** | (2006.01) |
| ***A47B 31/00*** | (2006.01) |

(52) U.S. Cl.

CPC ..... *A47L 19/04* (2013.01); *A47B 31/00* (2013.01); *A47B 96/021* (2013.01); *A47B 2031/003* (2013.01); *A47B 2031/007* (2013.01)

(58) Field of Classification Search

CPC ..... A47L 19/04; A47B 96/021; A47B 31/00; A47B 2031/007; A47B 2031/003

See application file for complete search history.

(56) References Cited

U.S. PATENT DOCUMENTS

| | | | | | |
|---|---|---|---|---|---|
| 1,994,195 | A | * | 3/1935 | Hay | A47J 47/16 211/41.11 |
| 2,338,290 | A | | 4/1943 | McDonald | |
| 2,600,755 | A | * | 6/1952 | Greensfelder | A47J 47/16 211/106 |
| 2,897,978 | A | * | 8/1959 | Beckner | A47B 55/02 108/107 |
| 3,007,708 | A | * | 11/1961 | Ochs | A47B 55/02 108/107 |
| 3,252,434 | A | * | 5/1966 | Young, Jr. | A47F 5/13 108/181 |
| 3,680,712 | A | | 8/1972 | Jurasek | |
| 3,915,097 | A | | 10/1975 | Young, Jr. | |
| 3,923,159 | A | | 12/1975 | Taylor et al. | |
| 3,977,529 | A | | 8/1976 | Stroh | |
| 4,157,070 | A | * | 6/1979 | Huempfner | A47B 96/00 108/107 |
| 4,895,382 | A | * | 1/1990 | Andersson | A47F 5/135 211/149 |
| 5,601,038 | A | * | 2/1997 | Welch | A47B 55/02 108/107 |

(Continued)

*Primary Examiner* — Ko H Chan

(74) *Attorney, Agent, or Firm* — Andrus Intellectual Property Law, LLP

(57) ABSTRACT

A tray rack includes opposed side support frames and a plurality of shelf hooks extend interior to the tray rack from the side support frames. Shelves include sides with a hang bar. Wires extend between the hang bars. The wires include a horizontal portion between upturned portions at either end. The upturned portion and the hang bars define the sides of the shelf. The shelves are connected between the opposed side support frames by engagement of the hang bars with the shelf hooks.

21 Claims, 9 Drawing Sheets

(56) References Cited

U.S. PATENT DOCUMENTS

| | | | | |
|---|---|---|---|---|
| 6,116,436 | A | 9/2000 | Ferrucci et al. | |
| 6,158,600 | A | 12/2000 | Ferrucci et al. | |
| 6,164,466 | A * | 12/2000 | Baradat | A22C 15/007 211/113 |
| 6,659,294 | B1 | 12/2003 | Simard | |
| D499,921 | S * | 12/2004 | Moon | D6/552 |
| D542,092 | S * | 5/2007 | Raichlen | D7/409 |
| 8,919,360 | B1 * | 12/2014 | Ransley | B08B 3/02 134/198 |
| 9,119,493 | B2 * | 9/2015 | Jeong | A47L 15/502 |
| 9,307,833 | B2 | 4/2016 | Rosen | |
| 9,357,840 | B2 | 6/2016 | Davis | |
| 9,565,989 | B2 * | 2/2017 | Maier | A47L 15/501 |
| 2006/0032829 | A1 * | 2/2006 | Hutzler | A47B 13/02 211/187 |
| 2006/0254992 | A1 * | 11/2006 | Lim | A47L 15/505 211/41.9 |
| 2008/0047916 | A1 | 2/2008 | Klingspor et al. | |
| 2008/0251482 | A1 | 10/2008 | Davis et al. | |
| 2015/0182104 | A1 * | 7/2015 | Jeong | A47L 15/505 134/92 |

* cited by examiner 10
26
22
16
22
22
72
72
72
72
72
72
72
24
56
56
56

WIRE FRAME DRYING RACK

CROSS-REFERENCE TO RELATED APPLICATION

The present application claims priority of U.S. Provisional Patent Application No. 62/582,578, filed on Nov. 7, 2017, the content of which is hereby incorporated herein by reference in its entirety.

BACKGROUND

The present disclosure relates to the field of kitchen or restaurant equipment. More specifically, the present disclosure relates to a mobile cart for drying and storing holding trays for the food service industry.

Many restaurant and food service settings, and particularly quick service restaurants (QSR), pre-prepare food or order components so as to efficiently use kitchen space and food preparation time. The pre-prepared foods or order components are stored in holding trays that are configured to maintain the quality of the food held therein for an extended period of time. Particularly in the QSR setting, a kitchen will use many of these trays throughout the day. Therefore the cleaning, drying, and storage of food holding trays presents a challenge, notably of space in the kitchen.

Wire frame utility carts are known in the industry, yet these carts are designed for general utility and therefore are not particularly or individually suited for specific tasks leading to inefficient use and operation. Jurasek U.S. Pat. No. 3,680,712, entitled "Modular Display Rack" discloses a modular display rack constructed of wire rod and includes a plurality of disconnectable rack sections with legs that interweave between offset horizontal rods to connect the racks to the side frames. Young, Jr. U.S. Pat. No. 3,915,097, entitled "Multi-Position Wire Display Rack" discloses a wire display rack in which each of a plurality of shelves which pivot about a rear hook and have downturned protrusions that fit into inwardly projecting loop deformations on the horizontal side members. Stroh U.S. Pat. No. 3,977,529, entitled "Display Rack" discloses a display rack in which shelves are secured to transverse portions of sidewalls by depending lugs that extend from the shelves and are received into loop portions of the transverse portions. Simard U.S. Pat. No. 6,659,294, entitled "Multi-Configurational Wire-Rod Display Rack" discloses a plurality of shelves with hook ends that connect over respective horizontal attachment rods of the side frames. Rosen U.S. Pat. No. 9,307,833, entitled "Shelving System" discloses a plurality of shelves with L shaped portions between which upper and lower bars of support frames are received.

BRIEF DISCLOSURE

Exemplary embodiments of a tray rack include opposed side support frames. A plurality of shelf hooks extend interior to the tray rack from the side support frames. Each shelf hook of the plurality of shelf hooks include a projection extending inwardly from the side support frame and a lip extending upward from the projection. A plurality of shelves each including a pair of sides. The sides each have a hang bar. A plurality of wires extend between the hang bars. Each wire of the plurality includes a horizontal portion between an upturned portion at either end. The upturned portion and the hang bars define the sides of the shelf. A shelf base is defined by the horizontal portions of the plurality of wires. End wires extend between the pair of sides along each elongated side of the shelf base. The end wires are positioned at a height above the shelf base. Each shelf of the plurality of shelves is connected between the opposed side support frames by engagement of the hang bars with the shelf hooks.

Additional exemplary embodiments of the tray rack include a plurality of shelf hooks arranged at vertically spaced apart intervals along the side support frames. A shelf of the plurality of shelves may be connected to the side support frames at a position adjacently above a lower shelf of the plurality of shelves. The shelf blocks disengagement of the lower shelf from the side support frames.

In still further exemplary embodiments, the side support frames each include vertical rods and a plurality of side horizontal supports that extend between the vertical rods of a side support frame. The side horizontal supports are vertically spaced apart at predetermined intervals along the vertical rods. A plurality of shelf hooks extend from each side horizontal support. The hang bars are divided along a length dimension into a plurality of intervals defined by the upturned portions connected to the hang bars. The shelf hooks extend from each side horizontal support. Intervals of a hang bar of an associated shelf engage the shelf hook extending from an associated horizontal support. The shelf hooks and the hang bar intervals may be coordinated such that a shelf hook engages the hang bar across substantially all of an associated interval of the hang bar. Upturned portions of the associated shelf may engage the side horizontal supports when the associated shelf is connected to the side support frames. The side horizontal supports may further each include a horizontal ledge that extends inwardly from the side horizontal support and the shelf hooks extend from the horizontal ledge. The shelves may be secured within an interior of a tray rack footprint defined by the opposed side support frames. A rear horizontal support may be connected between the opposed side support frames. A front horizontal support may be connected between the opposed side support frames.

In still further exemplary embodiments a shelf of the plurality of shelves may be configured to receive a food tray in a drying position wherein a top of the food tray is supported on the end wire. It is configured to receive a food tray in a storage position wherein a bottom of the food tray is supported by the shelf base and the storage position is defined by engagement of a side of the food tray with at least one of the end wires. The drying position may be further defined by engagement of a food tray lid projecting from the top of the food tray with at least one of the end wires.

A shelf of the plurality of shelves may include a plurality of lid supports connected to the shelf base and oriented at an obtuse angle relative to the shelf base. The plurality of lid supports may each be configured to support at least one lid positioned against the lid support. The shelf may further include a plurality of brackets with each bracket connected to the shelf base at a location proximate to a connection of a lid support to the shelf base. Each bracket may be oriented at an acute angle relative to the shelf base. At least one lid positioned against the lid support may be further supported by an associated bracket. An end of each bracket may be secured to an adjacent lid support at a position elevated above the shelf base.

DETAILED DISCLOSURE

Figure 1:
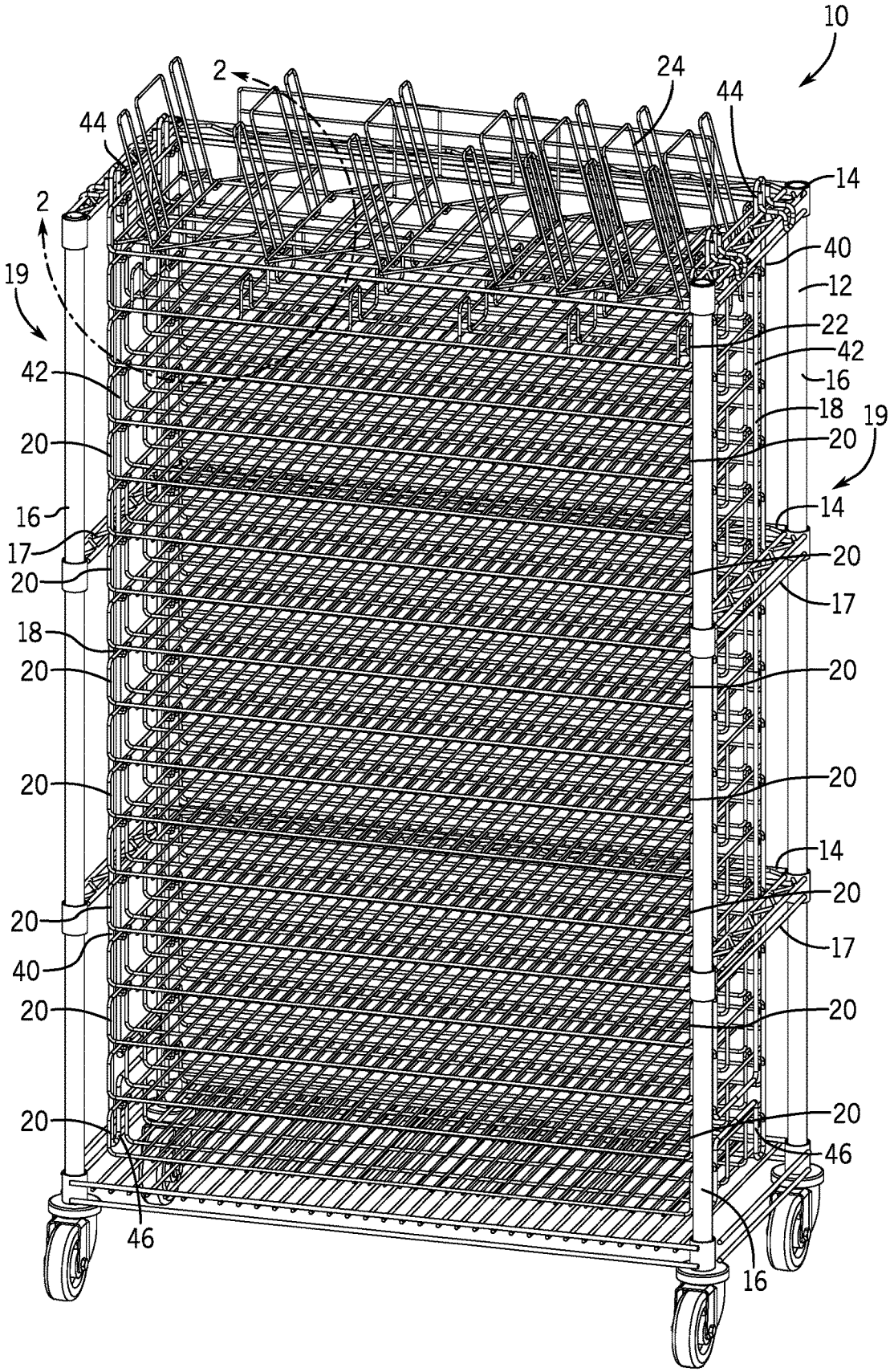
FIG. 1 is a perspective view of an exemplary embodiment of a tray rack.

FIG. 1 is a perspective view of an exemplary embodiment of a tray rack 10 including a cart 12. The cart 12 is exemplarily a wire cart of the type available from Metro Industries, Inc. The cart 12 exemplarily includes a plurality of three-sided supports 14 which secure about vertical rods 16. The three-sided supports are exemplarily constructed of horizontal supports 17 that extend between adjacent vertical rods 16.

Figure 10:
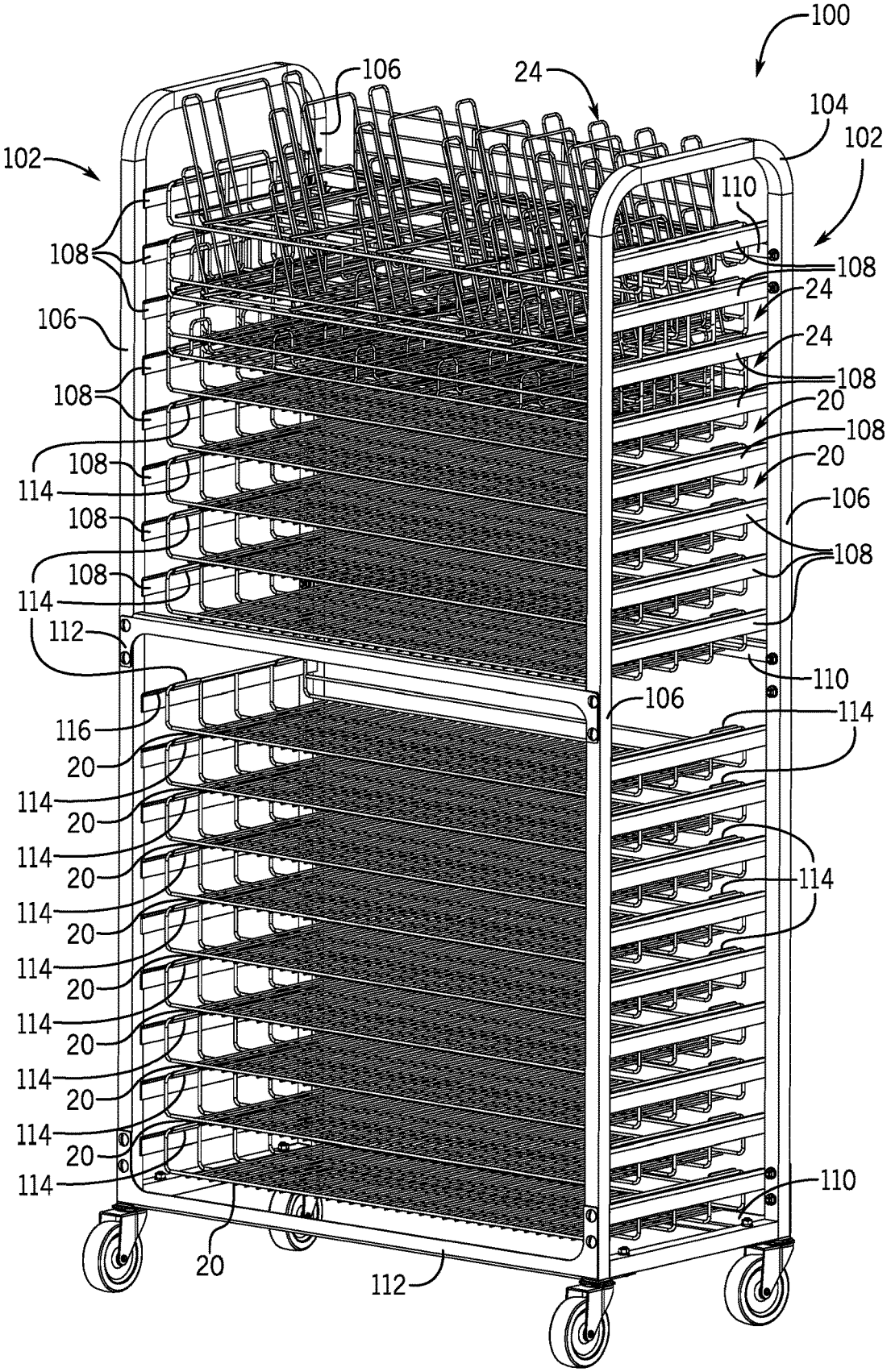
FIG. 10 is a perspective view of an additional exemplary embodiment of a tray rack.

The tray rack 10 includes two generally opposed sides 19, each side comprising adjacent vertical rods 16 and one or more horizontal supports 17. In the embodiment depicted in FIG. 1, the sides 19 include side support frames 18 that connect to the vertical rods 16 and/or horizontal supports 17. The side support frames 18 can be secured to or integrated with the vertical rods 16 of the cart 12, or may be moveable and thus removably secured to the three-sided supports 14 of the cart 12. The sides 19 include shelf hooks 32. As will be described in further detail herein, the shelf hooks 32 may be connected to the side support frames or may be A plurality of shelves 20 are secured between the two side support frames 18 to create a modular and reconfigurable tray rack for drying and/or storage of food service trays. It will be recognized that in an alternative embodiment, the tray rack 10 may be used separately from the cart 12, while in other embodiments, the tray rack 10 and the cart 12 are provided as a unit with removable shelves 20. FIG. 10, as will be described in further detail herein depicts an embodiment of the tray rack 10 in which the side support frame is integral with the vertical rods 16 of the cart 12. Embodiments of the tray rack 10 as described in the present application are adapted to be used with a plurality of different configurations of shelves 20. Examples of different configurations of shelves 20 are depicted and described in further detail with respect to FIGS. 3-5, as well as other figures of the specification. The tray rack 10 may also include partitioned shelves 22 and/or lid shelves 24 which provide additional functionality for the tray racks as provided herein.

Figure 2:
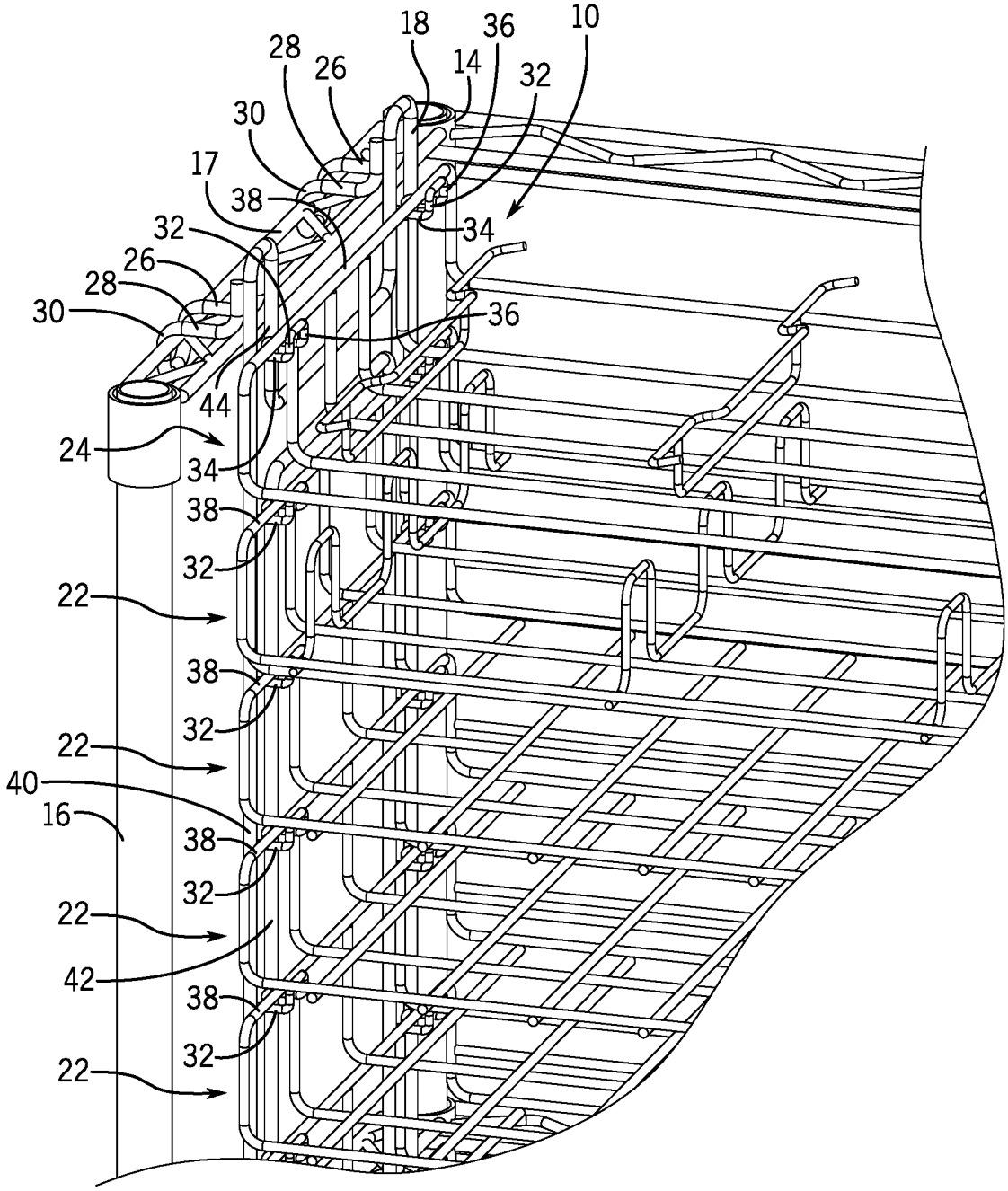
FIG. 2 is a detailed view of a portion of the tray rack of FIG. 1 indicated by line 2-2.

FIG. 2 is a detailed view of a portion of the tray rack 10 of FIG. 1 as indicated by line 2-2. With reference to FIGS. 1 and 2, the side support frame 18 is shown in more detail and includes cart hooks 26 which extend from an outer face of the side support frame 18 and are configured to engage about the three-sided support 14. In an exemplary embodiment, the cart hook 26 includes a projection 28 and a lip 30. The projection 28 transfers the weight of the tray rack 10 onto the three-sided support 14 while the lip 30 engages the side of the three-sided support 14 to resist horizontal movement of the side support frame 18. While the tray rack 10 is depicted in FIG. 1 as including two side support frames 18, it will be recognized that more or fewer side support frames may be used in additional embodiments. For example, in one embodiment, at least one side support frame may be positioned and configured for engagement with the "back" wall of the three-sided support 14. In still further embodiments, the side support frames 18 may be provided with a plurality of cart hooks 26 to secure to two or more of the three-sided supports 14 on each side of the cart.

The side support frame 18 further includes a series of shelf hooks 32 positioned to an interior side of the side support frame 18. The shelf hooks 32 exemplarily include a projection 34 and a lip 36. The projections 34 engage with and receive the weight from a hang bar 38 of a shelf 20 engaged therewith.

The lip 36 of the shelf hook 32 helps to retain the hang bar 38 in engagement with the projection 34 and prevents inward horizontal movement of the hang bar 38. In this manner, a series of shelves can be removably secured between generally opposed side support frames 18 to form a tray rack 10 that can be inserted and removed and reconfigured within a utility cart 12. It will also be recognized that the side support frames 18, and one or more shelves 20, 22, 24, may be secured together and to a utility cart 12 to provide a utility cart with the features as disclosed herein.

The cart hooks a 26 exemplarily open downwards with a downwardly extending lip 30 while the shelf hooks 32 exemplarily open upwardly with an upwardly extending lip 36. While the side support frame 18 is depicted in as having one pair of cart hooks 26, it will be recognized that in still further embodiments, the side support frame 18 may include additional cart hooks (not depicted), for example, positioned in alignment for engagement with other three-sided supports 14 of a cart 12 to which the side support frame 18 may be connected.

The side support frame 18 is exemplarily constructed with bent wire. In an exemplary embodiment, the side support frame 18 includes an outer frame 40 and an inner frame 42. The outer frame 40 is bent to provide the outer perimeter of the side support frame 18, including top projections 44 and lower projections 46 which help to provide definition and rigidity to the ends of the side support frame 18 while also providing a structure to which the cart hooks 26 and exemplarily the topmost and lowermost shelf hooks 32 may be secured.

The inner frame 42 further provides strength and rigidity to the side support frame 18 by extending along the interior of the side support frame 18. In an exemplary embodiment, the cart hooks 26 and the shelf hooks 32 are secured to the outer frame 40 and the inner frame 42 of the side support frame 18 by welding. In an exemplary embodiment, the shelf hooks 32 are welded between the outer frame 40 and the inner frame 42 thereby securing the outer frame 40 to the inner frame 42.

Figure 3:
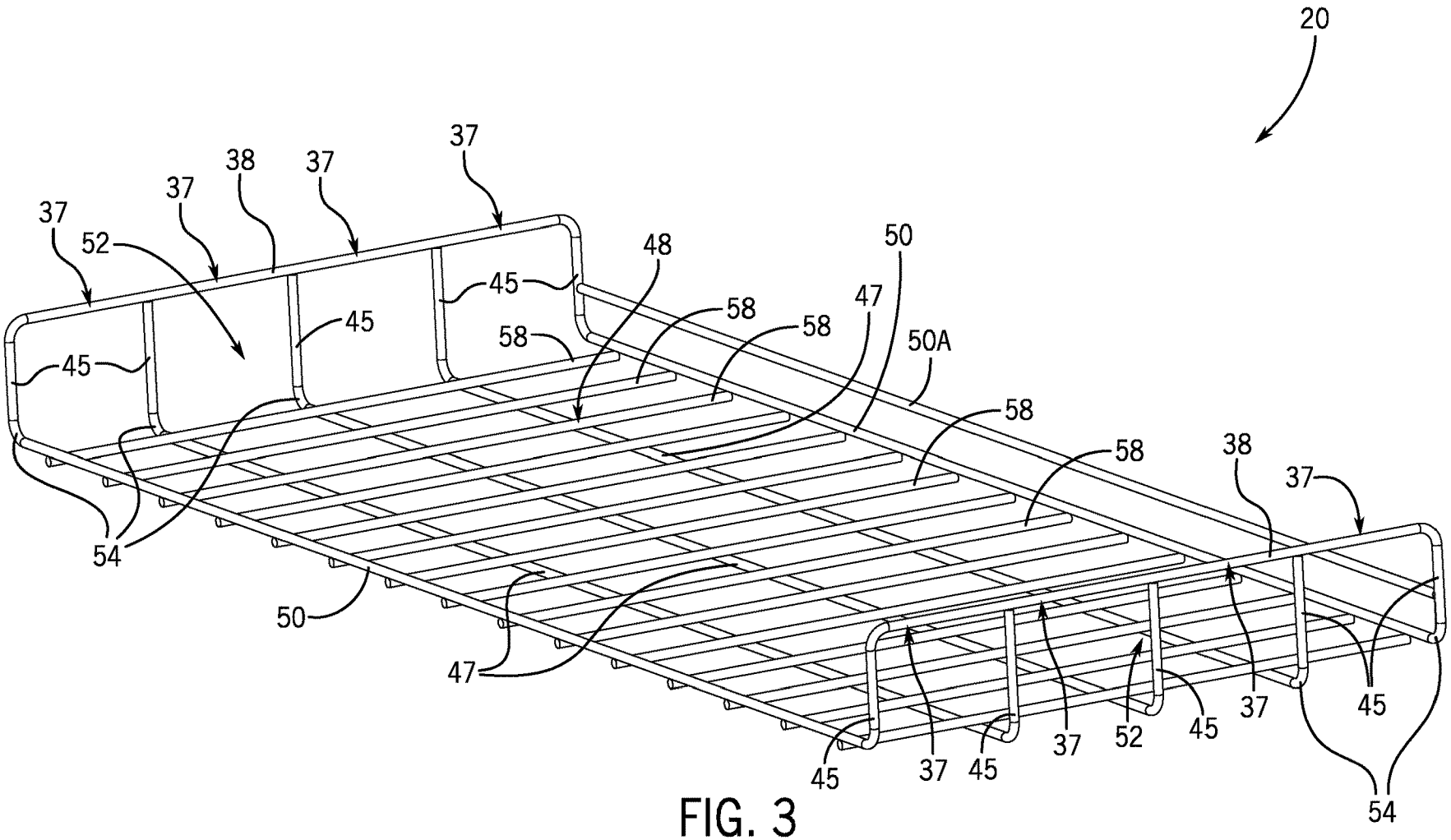
FIG. 3 is a perspective view of a shelf.
Figure 4:
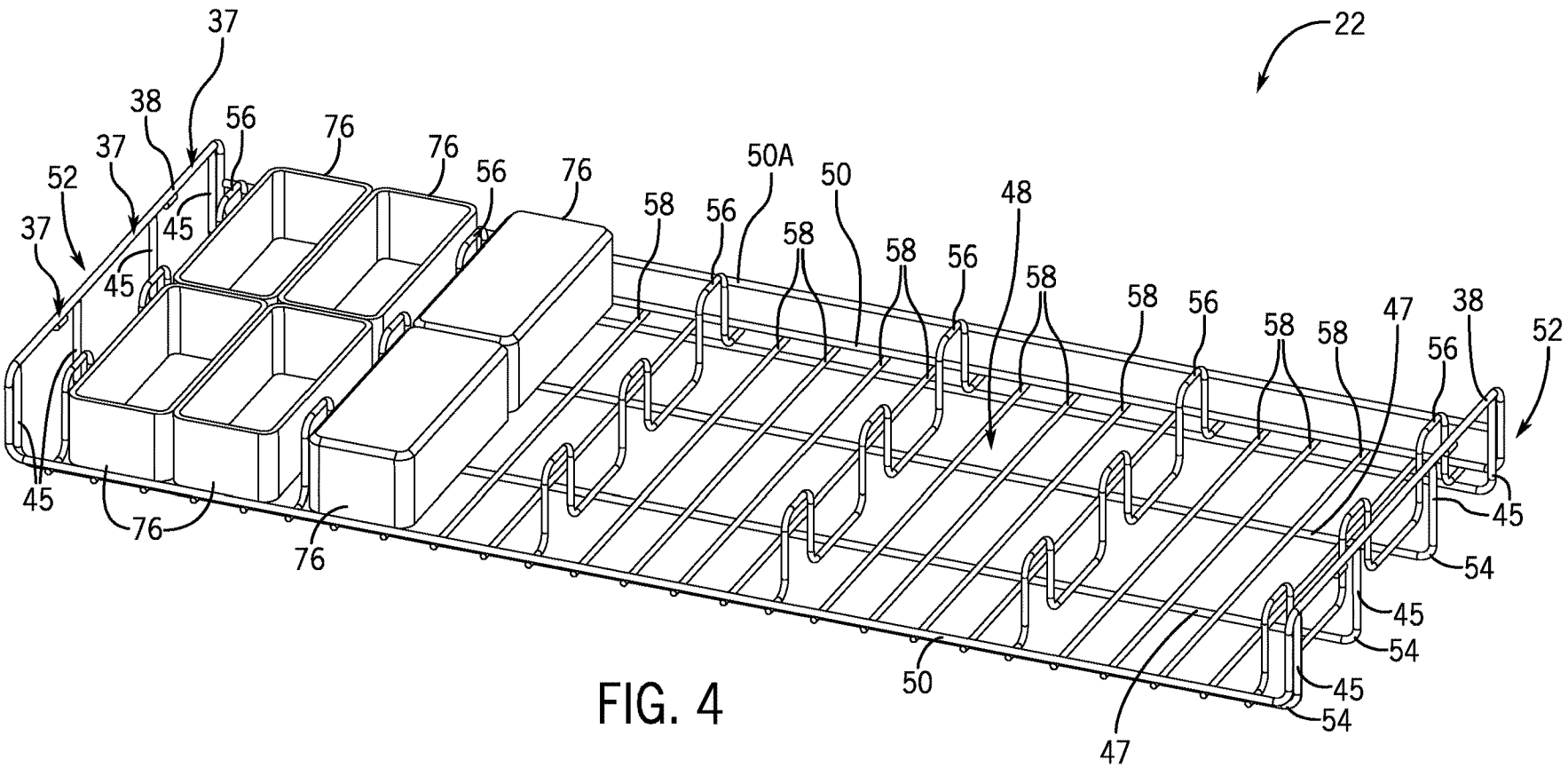
FIG. 4 is a perspective view of a partitioned shelf.
Figure 5:
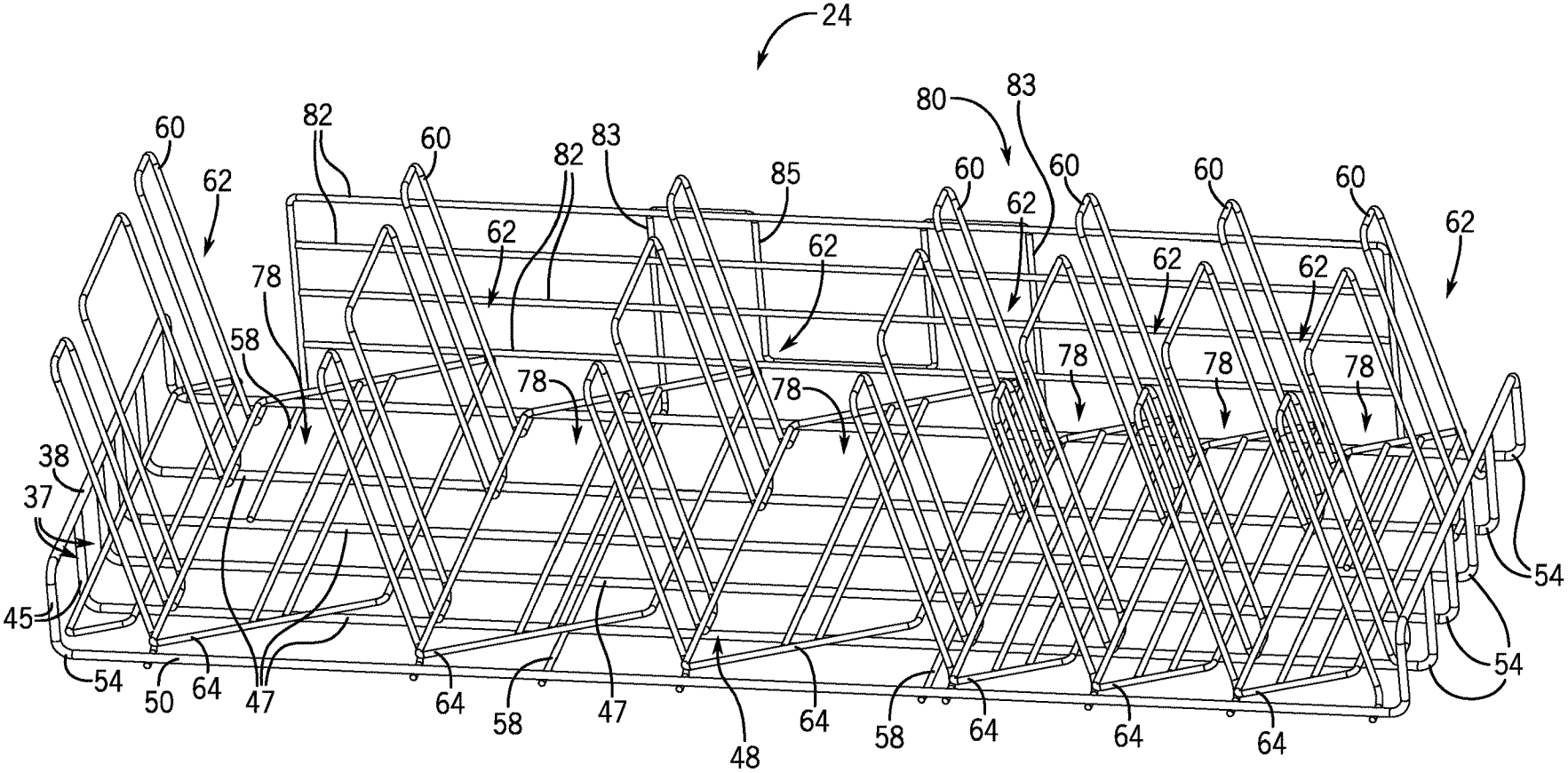
FIG. 5 is a perspective view of a lid shelf.

FIGS. 3-5 all depict exemplary embodiments of shelves which may be connected to side support frames 18 in embodiments of tray rack 10 as described herein. FIGS. 1, 2, 6, and 10 each exemplarily depict a plurality of different configurations of shelves used simultaneously with carts 12.

FIG. 3 is a perspective view of an exemplary embodiment of a shelf 20. Shelf 20 exemplarily includes hang bar 38 at either end thereof and a plurality of wires which form a shelf base 48. The shelf 20 further includes end wires 50 which extend between respective sidewalls 52 which may be constructed of wires 54. The wires 54 may exemplarily be U-shaped such that upturned portions 45 of the wires 54 forms both of the sidewalls 52 of the shelf 20, while horizontal portions 47 of the wires 54 support the shelf base 48. The upturned portions 45 of the wires 54 are joined to the hang bar 38 defining a plurality of intervals 37 of the hang bar 38 separated by the upturned portions 45.

The shelf base 48 may also be constructed of a plurality of base wires 58, the base wires 58 being exemplarily arranged perpendicular to the wires 54. The base wires 58 may be positioned and secured above the wires 54. It will further be recognized that in an embodiment, one of the wires 54 may also form the end wire 50. In exemplary embodiments, and in the embodiments as disclosed in further detail herein, the end wire 50 defines a height above the top of the shelf base 48. This may be achieved by the end wire 50 secured to the top of the base wires 58 shelf base 48, or an end wire 50A may be independently secured between the upturned portions 45 of a wire 54 at a position above the shelf base 48. Both of these configurations are shown in FIG. 3.

FIG. 4 is a perspective view of a partitioned shelf 22. In the partitioned shelf 22, a plurality of partitions 56 extend upward from the shelf base 48. In an exemplary embodiment compared to the shelf 20 depicted in FIG. 3, the shelf base 48 of FIG. 3 had been formed by a combination of base wires secured to the wire 54. In the exemplary embodiment of the partitioned shelf 22 in FIG. 6, the base wires 58 are instead formed into the partitions 56 and the wires 54 form the shelf base 48. Similar to that as shown in FIG. 3, the end wires 50 are secured about the base wires 58 which form the partition 56, thus the height of the end wires 50 are at a position above that of the shelf base 48.

An end wire 50A extends between upturned portions 45 supporting the end wire 50. The end wire 50A exemplarily blocks access to the shelf base 48, making the partitioned shelf 22 accessible from only the front to facilitate organization and retention of items on the partitioned shelf 22. The partitioned shelf 22 further exemplarily demonstrates the partitions 56 spaced at a distance from one another such that two tray inserts 76 can be stored therebetween side-by-side. In an exemplary embodiment, tray inserts 76 are dimensioned to fit within trays 66 as described in further detail herein. The partitioned shelf 22 may be dimensioned such that up to four tray inserts 76 may be stored (either open-side up or open-side down) between adjacent partitions 56 and the end wires 50. The partitions 56 thus help to keep the tray inserts 76 organized while not obstructing user access to the tray inserts 76.

FIG. 5 is a perspective view of an exemplary embodiment of a lid shelf 24. The lid shelf is exemplarily constructed in similar manners as described above with respect to the shelf 20 and the partitioned shelf 22. Further, the lid shelf 24 includes a plurality of lid support 60. The lid supports 60 are arranged at an angle to the shelf base 48. The lid supports 60 exemplarily include two portions, a support face 62 which is angled relative to the shelf base 48 and are configured to engage the lids held on the lid shelf 24. A bracket 64 is secured to the wires 54 of the shelf base 48 and is further secured to the support face 62 to hold the support face 62 at the previously mentioned angle relative to the shelf base 48. The lid shelf 24 is exemplarily configured to hold a plurality of lids for use with the trays held on the tray rack in an organized and accessible manner. The engagement between the bracket 64 to each of the lid supports 60 to which the bracket 64 is adjacent provides lateral rigidity to each of the lid supports 60, particularly as the bracket 64 is secured to the adjacent lid support at a position elevated from the shelf base 48. Furthermore, at the other end of the bracket 64, the bracket 64 is secured to the adjacent lid support 60 at or near the shelf base 48, including secured to or near to the base wires 58 or the horizontal portions 47 of the wires 54. This combination provides vertical and lateral rigidity to the shelf 24 and further to each of the The brackets 64 exemplarily extend between adjacent lid supports 60. In this manner, the brackets 64 create a platform 78 upon which the lids 72 are supported. The lid shelf 24 further includes an end wall 80, exemplarily constructed of a plurality of end wires 82. The end wall 80 may secure to the shelf base 48 with base wires 58 that connect to the end wires 82. In exemplary embodiments of the lid shelf, the end wall 80 includes a support loop 85 that extends between end wires 82. In a still further exemplary embodiment, the support loop 85 may further include vertical extensions 83 from the respective base wires 58.

Figure 6:
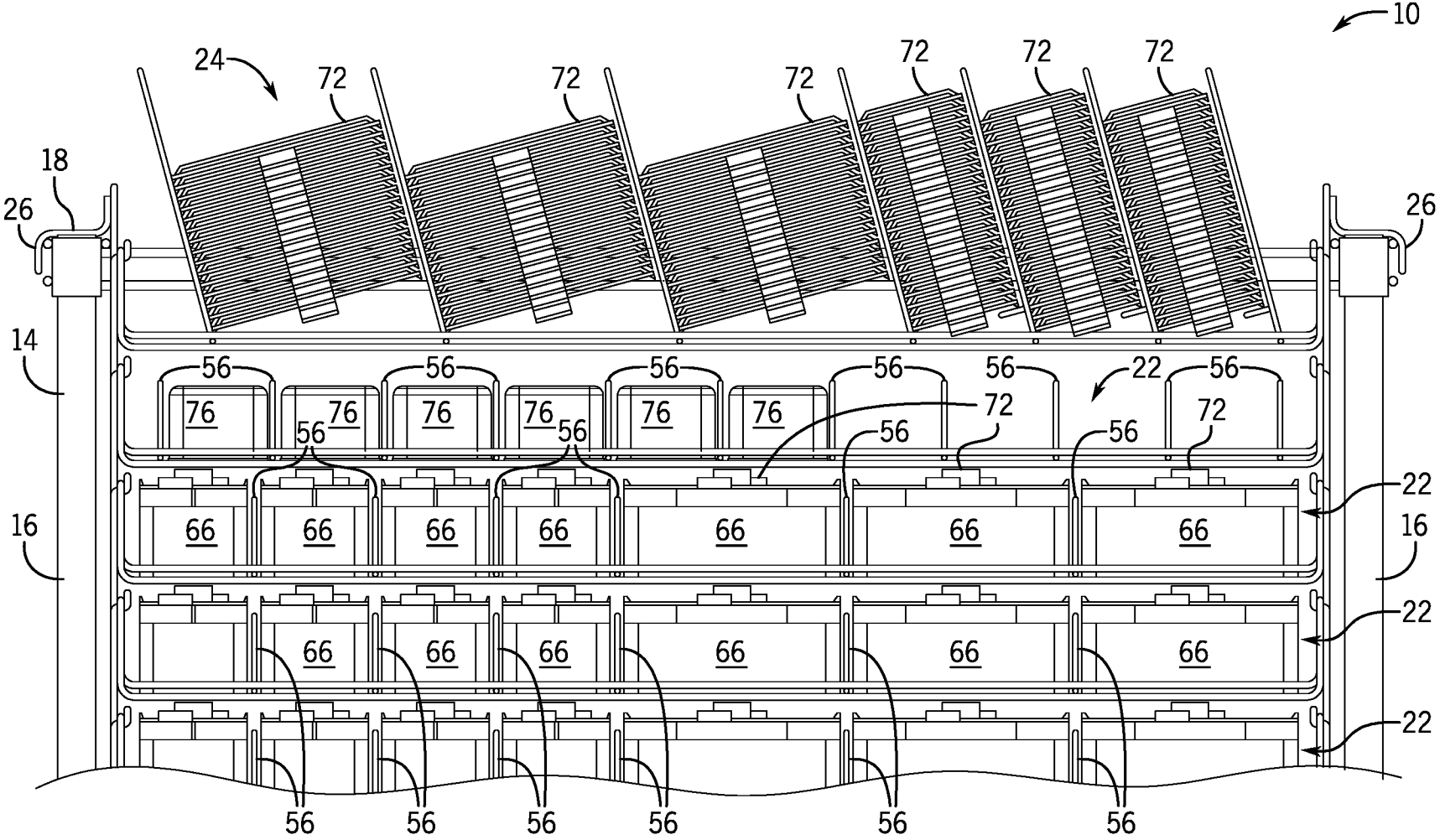
FIG. 6 is a front view of an exemplary embodiment of a tray rack loaded with items.

FIG. 6 is a front view of the tray rack 10 secured to a cart 12. The tray rack 10 exemplarily depicts examples of partitioned shelves 22 and a lid shelf 24. The partitioned shelves 22 are shown with various spacing between the partitions 56. The partitions 56 may be spaced so as to be able to receive a full-size tray 66 therebetween or to receive a half-size tray 66 therebetween. The partitioned shelves are dimensioned in the vertical direction such that the trays 66 with lids 72 secured thereto can fit within the spaces provided between the partitions 56. In another example, the partitions 56 are spaced so as to be able to receive a tray insert 76 therebetween. By way of reference to FIG. 4, the tray inserts 76 may be half the depth dimension of the tray rack 10. In an exemplary embodiment, two tray inserts 76 may fit within a half-size tray 66, while four tray inserts 76 may fit within a full-size tray 66. While the partitions 56 may be spaced differently for each storage item, in another embodiment, the partitions 56 are spaced so that one full-size tray 66, two half-size trays 66, or four tray inserts may fit on a respective partitioned shelf 22 between adjacent partitions 56. The tray rack 10 further depicts a plurality of extra lids 72, supported by the lid supports 60 and brackets 64, which define the angle at which the lids 72 are held. As further shown in FIG. 6, the lids 72 may exemplarily be provided as full-size tray lids 72 or as half size lids 72. These lids exemplarily engage with and secure to half-size and full-size trays 66.

Figure 7:
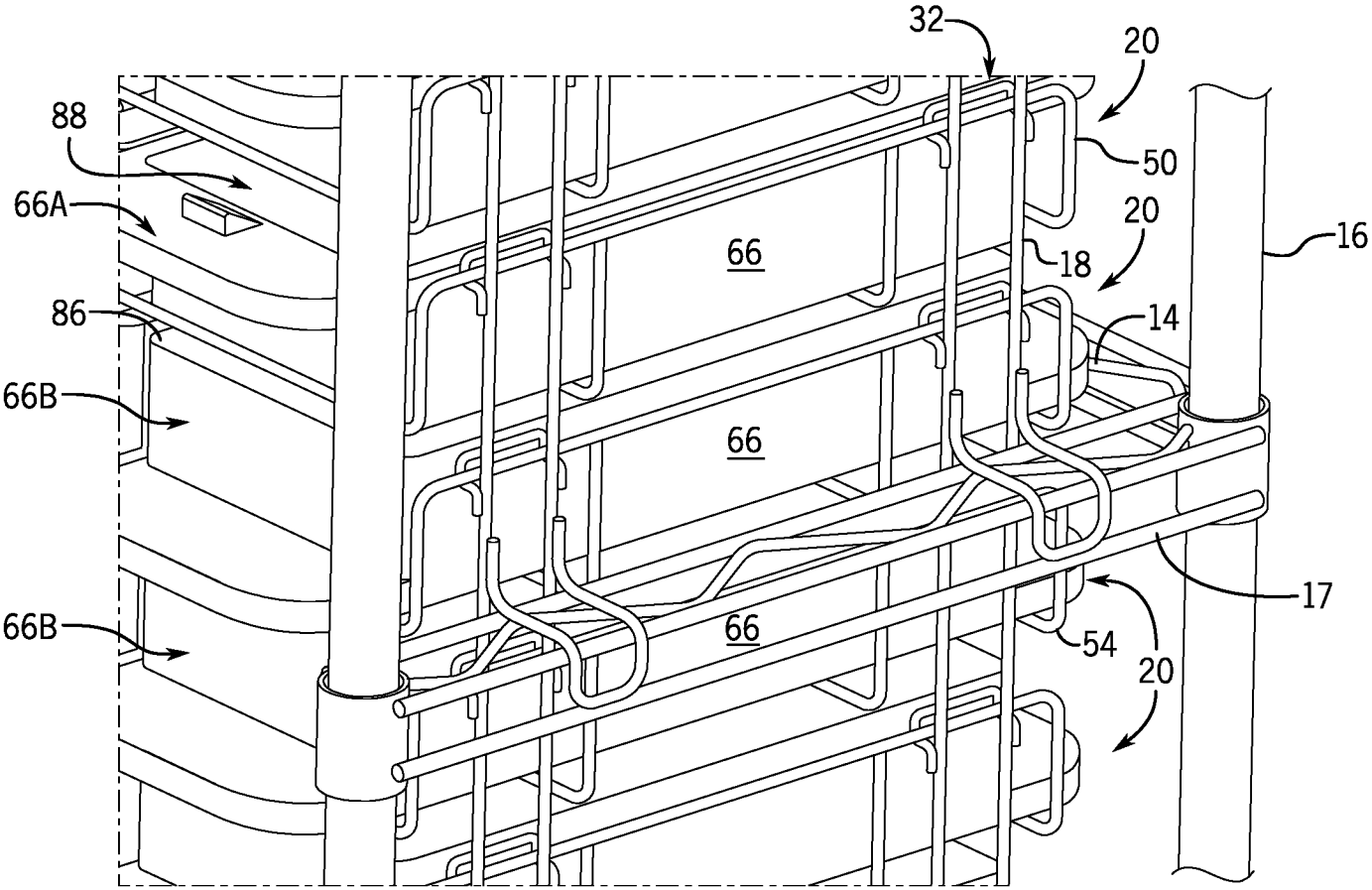
FIG. 7 is a detailed view of a side support frame engaged with a cart and trays stored in drying and storage positions.
Figure 8:
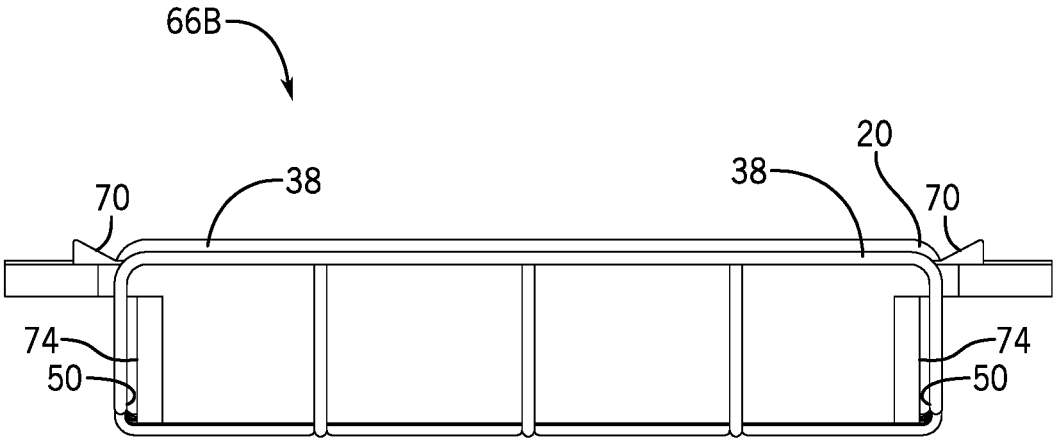
FIG. 8 is a side view of a tray in a storage position on a shelf.
Figure 9:
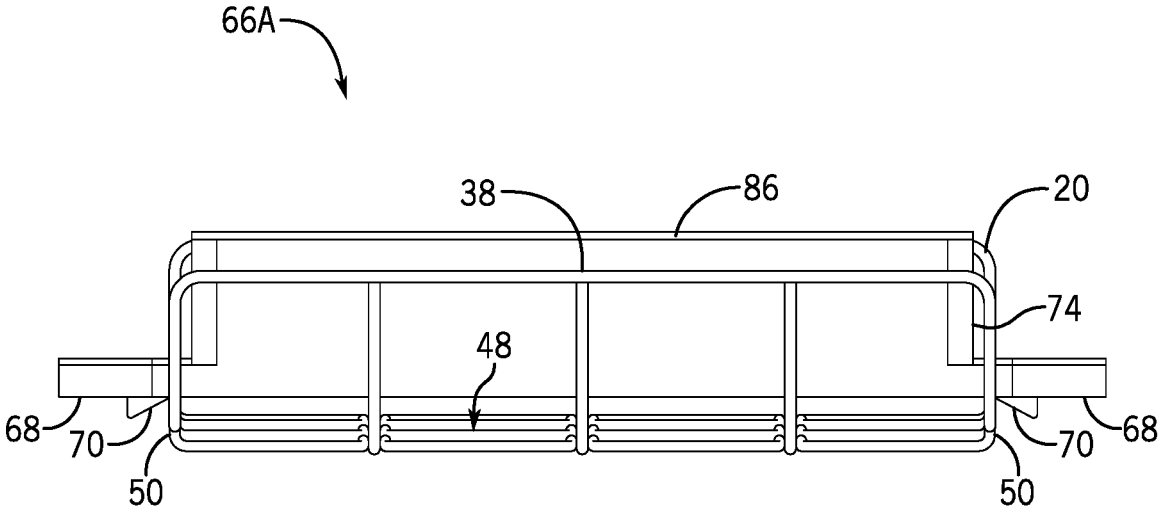
FIG. 9 is a side view of a tray in a drying position on a shelf.

FIG. 7 is a detailed perspective view of a portion of a side support frame 18 engaged with a cart 12 and with trays 66 stored in both the drying and storage positions. FIGS. 8 and 9 are respective side views of arrangements of trays 66. FIG. 7 exemplarily shows trays 66 in a storage position 66A which can be compared to trays stored in a drying position 66B. In the storage position 66A, the trays 66 are oriented upwardly which is opposed to the drying position 66B in which the trays are oriented downwardly. The trays 66 are arranged in the drying position 66B in an upside-down manner with a tray top 68 in engagement with the end wire 50. This holds the tray 66 in a position above the shelf base 48 which facilitates drying of the trays 66. The trays 66 exemplarily are constructed of sides 74 and a bottom 86 which collectively define an open interior 88. The tray top 68 extends outward from the sides 74, for example from the sides 74 of the tray 66 of a minor dimension of the tray 66. The tray top 68 includes tray lips 70. The tray lips 70 facilitate engagement between the trays 66 and respective lids 72.

The trays in the storage position 66A may further be combined with a respective lid 72 already associated with the tray 66. As previously noted, the tray lip 70 may be located at each end of the tray and helps to retain the lid 72 in engagement on the tray 66. When the tray is in the storage position 66A, a bottom of the tray rests upon the wires 54 forming the shelf base 48 while a side 74 of the tray 66 engages the end wire 50 which retains the tray in the storage position 66A within the tray rack 10. The end wires 50 extend at a position above the shelf base 48 so as to engage the sides 74 of the trays 66 and retain the trays 66 in position on the shelf 20.

FIGS. 8 and 9 are respective side views of arrangements of trays 66 in the storage position 66A, shown in FIG. 8 and trays 66 in the drying position 66B, shown in FIG. 9. In the drying position, the tray 66 is supported in an upside down manner to facilitate drying, and the tray 66 is supported at the tray top 68 in this position, without engagement with the shelf base 48. The orientation of the tray lips 70 relative to the end wires 50 help to maintain the tray 66 on the shelf 20 in this orientation. The end wires 50 are further configured so as to be received interior of the tray lips 70 which serve to help to keep the trays 66 retained within the tray rack 10 when the trays are in the drying position 66B. This feature and configuration helps to retain the trays in a position that facilitates drying of trays while enabling the trays to be both held on the tray rack and also easily removable from the tray rack. In this manner as shown by FIGS. 8 and 9, the shelf base 48 and end wires 50 of the shelf are coordinated with the associated tray 66 in a depth dimension as defined between the end wires 50 such that the shelf base 48 receives the tray 66 between the end wires 50 with the end wires closely proximate to or in engagement with exterior surfaces of the sides 74 of the tray body. The end wires 50 of the shelf 20 are further coordinated with the associated tray such that when the tray 66 is arranged in the drying position 66B, the tray lips 70 engage the end wires 50 with internally sloped surfaces of the tray lips 70.

FIG. 10 is a perspective view of an additional exemplary embodiment of a tray rack 100. The tray rack 100 depicted in FIG. 10 differs from that as depicted in FIG. 1 as the side support frames 102 are integrally constructed with the cart 104. The cart 104 and the side support frames 102 include vertical rod 106 and a plurality of side horizontal supports 108. Embodiments of the cart 104 further include one or more rear horizontal supports 110. Additionally, the cart 104 depicted in FIG. 10 also includes one or more front horizontal supports 112. The side horizontal supports 108 connect between adjacent vertical rods 106 of a side support frame 102, while the rear horizontal supports 110 and the front horizontal supports 112 connect between side support frame 102 to form the cart 104.

The side support frames 102 include shelf hooks 114 that extend inwardly and upwardly from the side horizontal support 108. As previously described, a variety of configurations of shelves, 20, 22, and 24 may be used with the tray rack 100. In exemplary embodiments, the shelf hooks 114 are elongated in a horizontal dimension along the lengthwise dimension of the side horizontal supports 108. The shelf hooks 114 and the respective shelves are configured such that the shelf hooks 114 are received between adjacent upturned portions 45 of the shelves within the intervals 37 of the hang bar 38. In this manner, the shelves are prevented or limited from translation in the horizontal dimension due to engagement between the shelf hooks 114 and the upturned portion 45. Also, because of the general correspondence between the width of the shelf hooks 114 in the horizontal dimension and the intervals 37 between adjacent upturned portions 45, disengagement of a respective shelf from the side horizontal supports 108 and/or the shelf hooks 114 requires at least one side of a respective shelf to be elevated entirely above the respective shelf hooks 114 so that the hang bar 38 and the upturned portions 45 can be moved past the associated shelf hooks 114. In such embodiment, the distance which the shelf must thus travel in the vertical dimension to be disengaged from the rest of the tray rack 100 presents a barrier to such disengagement and promotes resistance to disengagement between the shelves and the rest of the tray rack system.

During assembly, the shelves are secured to the shelf hooks 114 on the side support frames 102 by horizontally inserting the shelf at a position above the respective shelf hooks and lowering the shelf until it is in engagement with the shelf hooks 114 within the respective intervals 37 of the hang bars 38. The shelves 20 are added to the tray rack system 100 in a sequential order from bottom to top. This arrangement further resists disengagement of a shelf from the rest of the tray rack since the vertical distance required to elevate a shelf to disengage the shelf from the tray rack system 100 is blocked by the shelf located adjacently above. In this manner, so long as a shelf is located below an adjacent shelf, such shelf is further retained in position in engagement with the rest of the tray rack system 100, and in particular, to the shelf hooks 114 of the side horizontal supports 108.

In exemplary embodiments, and as depicted in FIG. 10, the side horizontal supports 108 may further include a horizontal ledge 116 that extends towards an interior of the tray rack 100 from the side horizontal supports 108. The shelf hooks 114 may further extend inwards and upwards from the horizontal ledges 116 of the side horizontal supports 108. In embodiments, the horizontal ledges 116 may provide further rigidity and strength to the horizontal supports 108 and thus to the entire side support frames 102 and cart 104. Additionally, the horizontal ledge 116 provides a further point of engagement with the respective shelf. In this manner, the shelves are exemplarily also in engagement with the side horizontal supports 108, or at least a portion thereof. Engagement between the horizontal ledge 116 or another portion of the side horizontal support 108 further constrains pivoting, twisting or rotative movement of a respective shelf, thus further directing the shelf to be moved in a generally vertical dimension relative to the shelf hooks 114 when engaging or disengaging a respective shelf from the rest of the tray rack system 100.

Exemplary embodiments of the tray rack as described herein can be used with a variety of shelf configurations, including shelf configurations with specific designs and/or components for specific purposes or uses. The shelves are moveable and removable, yet when assembled resist disengagement, providing a sturdy and reliable solution for kitchen equipment drying and storage. In exemplary embodiments, the entireties of the shelves are held within an envelope of the tray rack defined by the cart and thus the footprint of the tray rack remains consistent independent of the rack configuration, with and without shelves.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A tray rack comprising:

opposed side support frames;

a plurality of shelf hooks extending interior to the tray rack from the side support frames, each shelf hook of the plurality of shelf hooks comprising a projection extending inwardly from the side support frame and a lip extending upward from the projection; and a plurality of shelves, each shelf comprising:

a pair of sides each having a hang bar;

a plurality of wires extending between the hang bars, each wire of the plurality having a horizontal portion between an upturned portion at either end of the wire, the upturned portions and the hang bars defining the sides of the shelf;

a shelf base defined by the horizontal portions of the plurality of wires; and end wires extend between the pair of sides along each elongated side of the shelf base, each of the end wires is between a second upturned portion at either end of the end wires, the second upturned portions connecting to the hang bars and each end wire positioned at a height above the shelf base and below the hang bars;

wherein each shelf of the plurality of shelves is connected between the opposed side support frames by engagement of the hang bars with the shelf hooks.

2. The tray rack of claim 1, wherein the plurality of shelf hooks are arranged at vertically spaced apart intervals along the side support frames.

3. The tray rack of claim 2, wherein a shelf of the plurality of shelves connected to the side support frames at a position adjacently above a lower shelf of the plurality of shelves, blocks disengagement of the lower shelf from the side support frames.

4. The tray rack of claim 1, wherein the side support frames each comprise vertical rods and a plurality of side horizontal supports that extend between the vertical rods of a side support frame, wherein the side horizontal supports are vertically spaced apart at predetermined intervals along the vertical rods.

5. The tray rack of claim 4, wherein a plurality of shelf hooks extend from each side horizontal support.

6. The tray rack of claim 5, wherein the hang bars are divided along a length dimension into a plurality of intervals defined by the upturned portions connected to the hang bars, and the shelf hooks extending from each side horizontal support engage intervals of a hang bar of an associated shelf.

7. The tray rack of claim 6, wherein the shelf hooks and the hang bar intervals are coordinated such that a shelf hook engages the hang bar across substantially all of an associated interval of the hang bar.

8. The tray rack of claim 6, wherein the upturned portions of the associated shelf engage the side horizontal supports when the associated shelf is connected to the side support frames.

9. The tray rack of claim 6, wherein the side horizontal supports further each comprise a horizontal ledge extending inwardly from the side horizontal support and the shelf hooks extend from the horizontal ledge.

10. The tray rack of claim 5, wherein the shelves are secured within an interior of a tray rack footprint defined by the opposed side support frames.

11. The tray rack of claim 4, further comprising a rear horizontal support connected between the opposed side support frames.

12. The tray rack of claim 11, further comprising at least one front horizontal support connected between the opposed side support frames.

13. The tray rack of claim 1, wherein a shelf of the plurality of shelves is configured to receive a food tray in a drying position wherein a top of the food tray is supported on the end wires, and the shelf is configured to receive a food tray in a storage position wherein a bottom of the food tray is supported by the shelf base and the storage position is defined by engagement of a side of the food tray with at least one of the end wires.

14. The tray rack of claim 13, wherein the drying position is further defined by engagement of a food tray lip projecting from the top of the food tray with at least one of the end wires.

15. The tray rack of claim 1, wherein a shelf of the plurality of shelves comprises a plurality of lid supports connected to the shelf base and oriented at an obtuse angle relative to the shelf base, the plurality of lid supports each configured to support at least one lid positioned against the lid support.

16. The tray rack of claim 15, wherein the shelf further comprises a plurality of brackets each connected to the shelf base at a location proximate a connection of a lid support to the shelf base, each bracket oriented at an acute angle relative to the shelf base, wherein at least one lid positioned against the lid support is supported by an associated bracket.

17. The tray rack of claim 16, wherein an end of each bracket is secured to an adjacent lid support at a position elevated above the shelf base.

18. The tray rack of claim 1, wherein at least one shelf of the plurality of shelves comprises at least one partition extending between the end wires.

19. The tray rack of claim 1, wherein the tray rack is configured to be removably connected to a utility cart.

20. The tray rack of claim 1, wherein the tray rack is rigidly secured to a utility cart.

21. The tray rack of claim 1, wherein each of the plurality of shelves further comprises a plurality of base wires arranged perpendicular to and above the horizontal portions of the plurality of wires, wherein the shelf base is further defined by the plurality of base wires, and wherein the end wires are positioned along the plurality of base wires on a side of the plurality of base wires opposite the horizontal wires.

* * * * *